US006659231B2

(12) United States Patent
Orndorff et al.

(10) Patent No.: US 6,659,231 B2
(45) Date of Patent: Dec. 9, 2003

(54) SELF-BALANCING SYNCHRONIZATION ASSEMBLY FOR A HYDRAULIC ELEVATOR

(75) Inventors: Karl B. Orndorff, Gettysburg, PA (US); Eileen W. Rossman, Arroyo Grande, CA (US)

(73) Assignee: Inventio AG, Hergiswil (CH)

( * ) Notice: Subject to any disclaimer, the term of this patent is extended or adjusted under 35 U.S.C. 154(b) by 94 days.

(21) Appl. No.: 10/095,839

(22) Filed: Mar. 12, 2002

(65) Prior Publication Data

US 2003/0183459 A1 Oct. 2, 2003

(51) Int. Cl.[7] ..... B66B 9/04

(52) U.S. Cl. ..... 187/253; 187/272; 187/413; 92/137

(58) Field of Search ..... 187/253, 272–275, 187/406, 411, 412, 413; 92/52, 137

(56) References Cited

U.S. PATENT DOCUMENTS

| | | | | |
|---|---|---|---|---|
| 1,064,794 A | | 6/1913 | Wadsworth | |
| 2,417,947 A | * | 3/1947 | Reedy | 187/253 |
| 5,443,140 A | * | 8/1995 | Nagel et al. | 187/253 |
| 5,653,311 A | * | 8/1997 | Heikkinen et al. | 187/253 |
| 6,085,872 A | * | 7/2000 | Gilliland et al. | 187/253 |
| 6,098,759 A | | 8/2000 | Rossman et al. | |
| 6,148,961 A | * | 11/2000 | Kadoche | 187/253 |

FOREIGN PATENT DOCUMENTS

| | | | | |
|---|---|---|---|---|
| CH | 463 745 | | 1/1968 | |
| EP | 0 882 895 | | 12/1998 | |
| ES | 8 503 413 | | 6/1984 | |
| JP | 10036034 A | * | 2/1998 | B66B/7/00 |
| JP | 10258979 A | * | 9/1998 | B66B/9/04 |

* cited by examiner

*Primary Examiner*—Eileen D Lillis
*Assistant Examiner*—Thuy V. Tran
(74) *Attorney, Agent, or Firm*—MacMillan, Sobanski & Todd LLC

(57) ABSTRACT

A self-balancing synchronization assembly has a support beam pivotally mounted on a guide rail adjacent a hydraulic elevator jack. A synchronization bracket is pivotally mounted at one end of the beam and a pair of synchronization cables is connected between the bracket and a telescoping part of the jack. A return cable is connected between the other end of the beam and the hoistway pit to balance the load and includes a turnbuckle for retensioning the synchronization cables. A second synchronization bracket can be pivotally mounted at the one end of the support beam to synchronize a three-stage jack.

12 Claims, 2 Drawing Sheets

SELF-BALANCING SYNCHRONIZATION ASSEMBLY FOR A HYDRAULIC ELEVATOR

BACKGROUND OF THE INVENTION

The present invention relates generally to hydraulic elevators and, in particular, to a self-balancing synchronization assembly for a jack in a hydraulic elevator.

Hydraulic elevator systems are well known. Such systems include an elevator car movable along guide rails within a hoistway, and a jack with at least one telescoping piston slidably received in a corresponding cylinder supporting and moving the elevator car. A pressurized working fluid, such as oil, is introduced into or removed from the volume between the telescoping piston and the interior of the cylinder in order to reciprocate the piston and move the elevator car vertically within the hoistway.

If the hydraulic elevator utilizes two or more telescoping pistons, a synchronizing device must be provided to coordinate movement of the pistons. The Swiss patent publication 463 745 shows an elevator with a hydraulic or pneumatic telescopic ram having two or three pistons. A mechanical connecting means engages between the telescopic parts and in each stroke ensures uniformly distributed part strokes between the successive telescopic parts. Chains or cables deflected over rollers are, in particular, used as the mechanical connecting means.

The U.S. Pat. No. 6,098,759 shows another hydraulic elevator construction having a pair of ropes connected at one end to a crossbeam mounted on the guide rails at the top end of the hoistway. The elevator car is supported by a jack of the two-stage type with an intermediate piston and a lower piston telescopically extending from an upper cylinder. The other end of each rope is attached to a sleeve on the cylinder. An intermediate portion of each rope extend below the ends and passes over an associated sheave rotatably mounted on an intermediate piston of the jack thereby changing direction by 180 degrees.

The known synchronizing devices have problems such as requiring room at the top of the hoistway for mounting and typically being custom designed to fit the particular hoistway configuration. The multiple synchronization cables require individual adjustment for retensioning either at the hoistway mounting point or at the attachment point on the jack flange.

SUMMARY OF THE INVENTION

The present invention concerns a self-balancing synchronization assembly for a hydraulic elevator system. The synchronization assembly includes a support beam which mounts via a pivoting pin to an elevator car guide rail, rather than the piston flange as in the prior art. The support beam has first and second ends that extend on either side of the guide rail. On the first end, the beam supports the downward load of at least one pair of synchronization cables. On the second end, a support cable extends downwardly to the elevator pit and attaches to the pit floor via a turnbuckle or similar tensioning device. The corresponding synchronization cables for each piston flange and the support cable mount to a synchronization bracket and support bracket, respectively, each of which is attached to the support beam by a pivoting pin connection. The pivoting connection allows the matching two synchronization cables for each piston flange to equalize loads. The synchronization cables create a resultant downward load on the first end of the pivoting support beam. A load, therefore, is required on the second end of the support beam to balance the synchronization load, which is accomplished by the support cable mounted to the support bracket on the second end of the support beam. The support cable extends to the elevator pit or hoistway floor, which advantageously allows cable tensioning from a single point at the elevator pit floor.

The synchronization assembly according to the present invention also eliminates all hoistway wall or overhead attachment interfaces, which permits tensioning of the cables in the hoistway pit, which is easier to access and has more structural strength than connections at the hoistway walls or the piston flanges.

In addition, the present invention allows the installation of the same equipment regardless of the building type because the present invention uses a single beam design for all variations of hoistway width and construction type.

Furthermore, the present invention can be used to synchronize two-stage and three-stage hydraulic elevators because each pair of synchronization cables is attach to a separate synchronization bracket.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

A dual-jack type elevator has a separate hydraulic jack positioned adjacent each sidewall of the elevator hoistway for raising and lowering an elevator car. As described above, the jacks can be a two-stage or a three-stage type that requires synchronization of the telescoping parts for smooth elevator operation. The synchronization assembly according to the present invention permits tensioning of all synchronizing cables from a single point in the hoistway pit and can be used in all types of hoistway construction.

Figure 1:
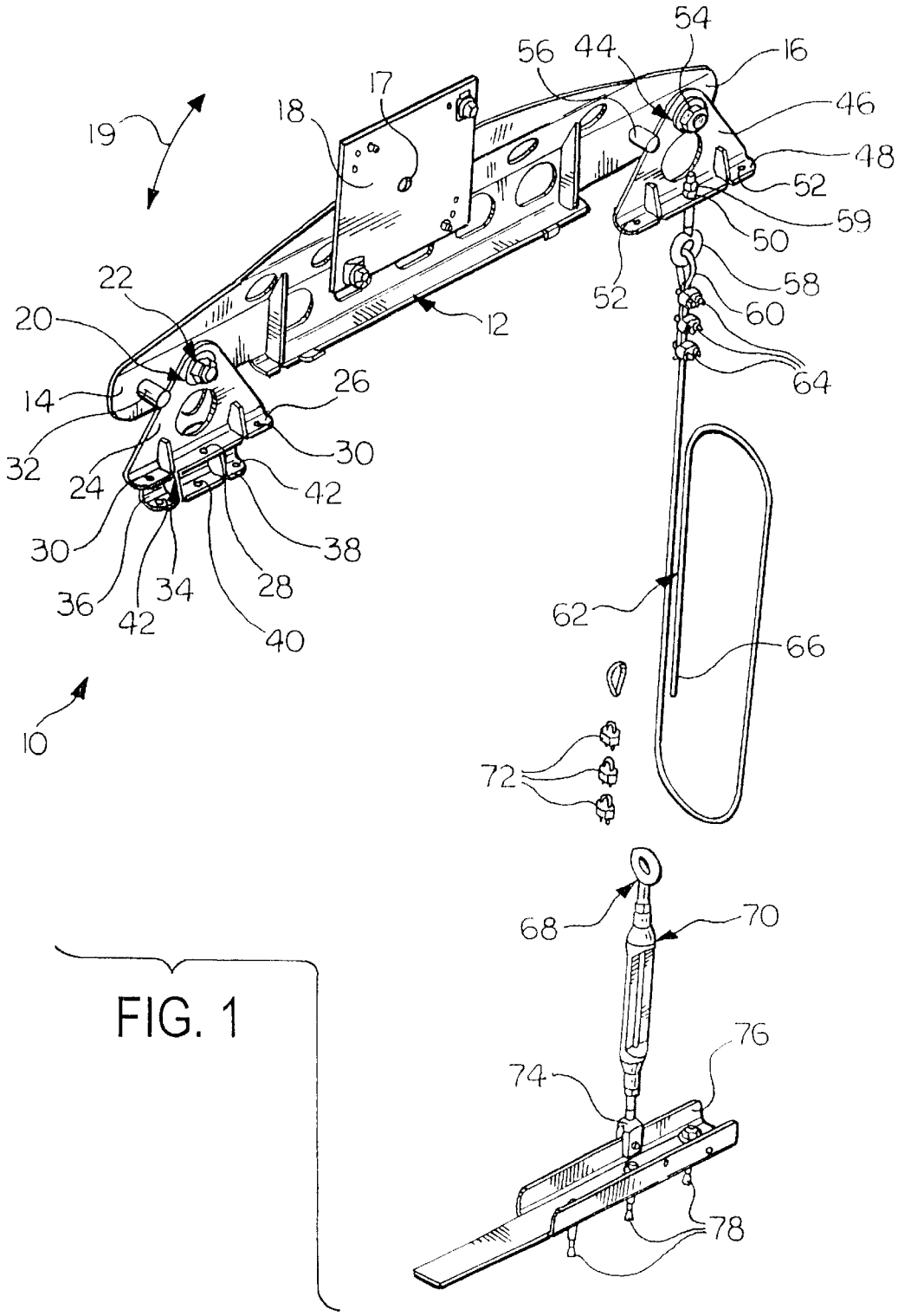
FIG. 1 is a partially exploded perspective view of a self-balancing synchronization assembly for an elevator jack in accordance with the present invention.

Referring now to FIG. 1, a self-balancing synchronization assembly is indicated generally at 10. The synchronization assembly 10 includes an elongated support beam 12 having a first end 14 and a second end 16. The support beam 12 is pivotably mounted by a pivot pin 17, or other suitable attachment means, to a pivot plate 18 intermediate the first end 14 and the second end 16. The pivot plate 18 is adapted to be affixed to a guide rail (FIG. 2) for a hydraulic elevator such that the support beam 12 pivots (as shown by an arrow 19) in a generally vertical plane about a pivot point defined by the pivot pin 17. The support beam 12 preferably is sized to extend across much of the width of an elevator hoistway sidewall.

A generally triangular-shaped first synchronization bracket 20 is pivotably attached adjacent to the first end 14 of the support beam 12 by a pin connection 22 or similar pivoting attachment means at an apex of the triangle. The first synchronization bracket 20 includes a generally planar bracket portion 24 and a mounting portion 26 extending generally perpendicularly from a base of the bracket portion 24. The mounting portion 26 includes a center attachment aperture 28 located below the pin connection 22 and a pair of outer attachment apertures 30 formed therein. Each of the attachment apertures 28 and 30 is adapted to attach to an end of a synchronization cable (FIG. 2) having an opposite end attached to a flange (not shown) of an elevator piston. A first bracket stop 32 extends generally perpendicularly from the support beam 12 between the first end 14 and the pin connection 22 for engaging an edge of the bracket portion 24 to limit the pivoting movement of the first synchronization bracket 20.

A generally triangular-shaped second synchronization bracket 34 is also shown having the same general configuration as the first synchronization bracket 20, including a bracket portion 36, a mounting portion 38, a center attachment aperture 40 and a pair of outer attachment apertures 42. The second synchronization bracket 34 is pivotably mounted on the pin connection 22 between the first synchronization bracket 20 and the support beam 12. Each of the attachment apertures 40 and 42 is adapted to attach to an end a synchronization cable (FIG. 2) in a manner similar to the apertures 28 and 30.

A return bracket 44, generally having the same structure as the synchronization bracket 20, includes a bracket portion 46, a mounting portion 48, a center attachment aperture 50 and a pair of outer attachment apertures 52. The return bracket 44 is pivotably attached adjacent to the second end 16 of the support beam 12 by a pin connection 54 or similar pivoting attachment means. A bracket stop 56 extends generally perpendicularly from the support beam 12 on the side of the bracket portion 46 opposite the second end 16 for engaging an edge of the return bracket 44 to limit pivoting movement thereof. The bracket 44 can be identical to the bracket 20. In the alternative, the center aperture 40 and the outer apertures 52 can be eliminated, or the bracket 44 can be fixedly attached to the support beam 12, or the bracket 44 can be eliminated and the aperture 50 formed in the support beam.

An eyebolt 58 is shown mounted in the center attachment aperture 52 extending downwardly and retained by a nut 59 or similar attachment means. An upper end 60 of a return cable 62 is threaded through the eye of the eyebolt 58 and affixed to the cable by a plurality of U-bolts 64 or similar cable termination means. Alternatively, the return cable 62 can be received in one of the apertures 52 and 54 in the return bracket 44 or a similar aperture formed in the support beam 12. A lower end 66 of the support cable 62 can be attached to an upper end 68 of a turnbuckle 70 near the pit floor (not shown) by a plurality of U-bolts 72 or similar cable termination means of adequate strength and efficiency. A lower end 74 of the turnbuckle 70 attaches to an anchor plate 76, which in turn mounts directly to the elevator pit floor using a plurality of concrete anchors 78 or similar fasteners.

Figure 2:
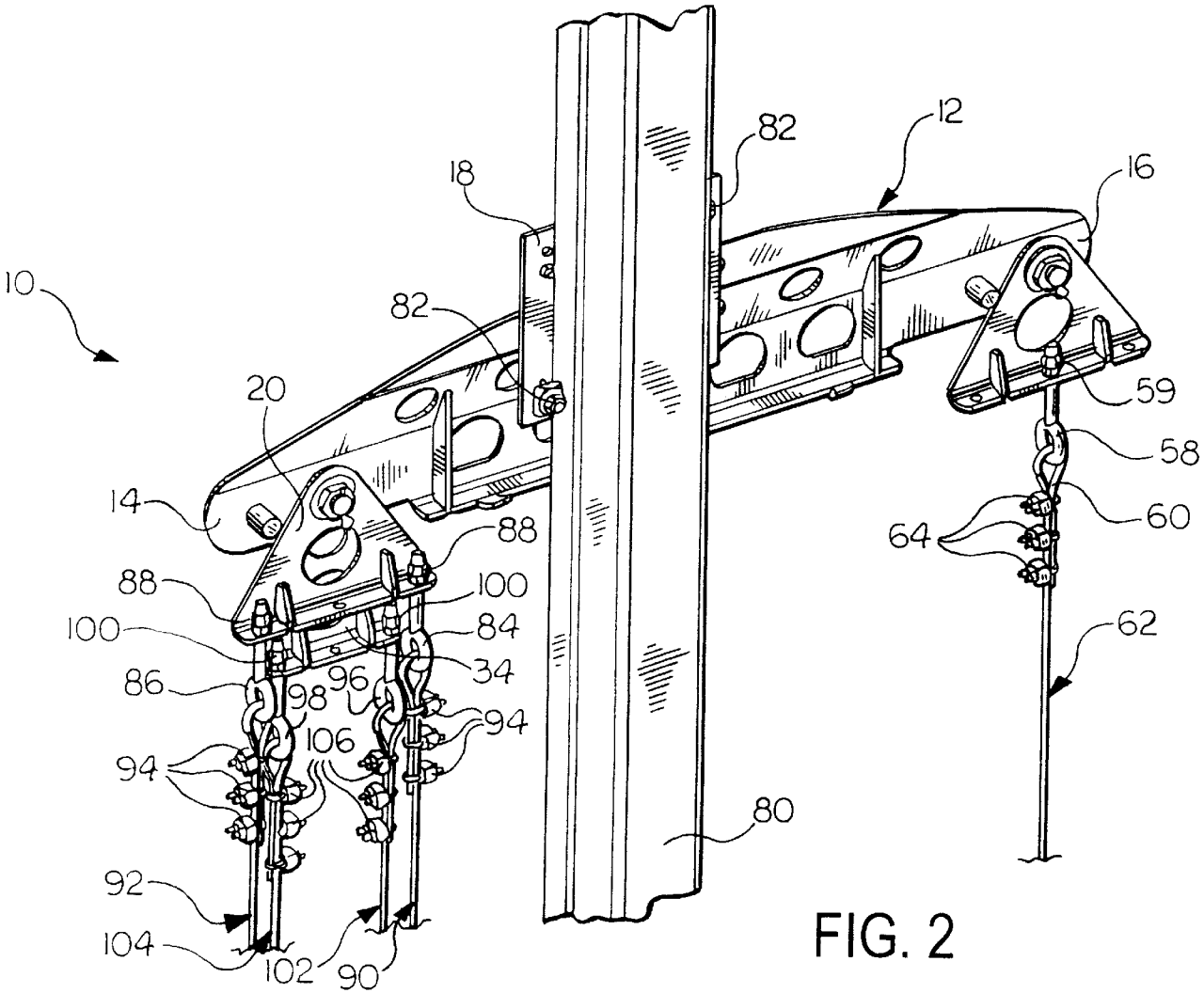
FIG. 2 is an enlarged fragmentary perspective view of the self-balancing synchronization assembly shown in FIG. 1 attached to an elevator guide rail and having a plurality of cables attached thereto.

Referring now to FIG. 2, the synchronization assembly 10 is shown with the pivot plate 18 attached to an elevator guide rail 80 by a plurality of fasteners 82. The synchronization brackets 20 and 34 are pivotally attached to the first end 14 of the support beam 12 extending beyond one side of the guide rail 80. The return bracket 44 is attached to the second end 16 of the support beam 12 extending beyond the other side of the guide rail 80. The support eyebolt 58 attaches the cable upper end 60 to the support bracket 44.

Each of a pair of eyebolts 84 and 86 is attached to the first synchronization bracket by fasteners 88 or similar attachment means at the apertures 30. A pair of synchronization cables 90 and 92 forms a first synchronization cable pair. An upper end of the synchronization cable 90 is retained by the eyebolt 84 and affixed onto itself by a plurality of U-bolts 94 or similar cable termination means. An upper end of the synchronization cable 92 is retained by the eyebolt 86 and affixed onto itself by a plurality of the U-bolts 94 or similar cable termination means. Each of a pair of eyebolts 96 and 98 is attached to the second synchronization bracket 34 by fasteners 100 or similar attachment means. A pair of synchronization cables 102 and 104 forms a second synchronization cable pair. An upper end of the synchronization cable 102 is retained by the eyebolt 96 and affixed onto itself by a plurality of U-bolts 106 or similar cable termination means. An upper end of the synchronization cable 104 is retained by the eyebolt 98 and affixed onto itself by a plurality of the U-bolts 106 or similar cable termination means.

The lower ends (not shown) of the synchronization cables attach to one or more flanges of the hydraulic elevator jack in a manner similar to the attachment to the brackets 20 and 34. For example, when utilized with a two-stage jack, only the cables 90 and 92 need be attached to opposite sides of a jack flange and the cables 102 and 104 as well as the bracket 34 can be eliminated. An alternative is to utilize the cables 102 and 104 and eliminate the cables 90 and 92 and the bracket 20. When utilized with a three-stage jack, the cables 90 and 92 are attached to opposite sides of one piston flange and the cables 102 and 104 are attached to opposite sides of the other piston flange. For the best elevator ride, the load on the synchronization cables must be nearly equal to provide equal loading between the sides of the jack flanges. The pivot assembly provided by both the brackets 20 and 34 equalizes uneven cable tension between the two cables attached to the bracket through rotation about the pin 22.

The synchronization assembly 10 is installed by mounting the pivot plate 18 to the guide rail 80 and attaching the lower ends of the synchronization cables 90 and 92 (and 102 and 104 if required) to the jack flange. The turnbuckle 70 at the lower end 66 of the return cable 62 is attached to the anchor plate 76 that has been affixed to the bottom of the hoistway pit. The synchronization cables and the return cable are adjusted to balance the load on the ends 14 and 16 of the support beam such that the beam is substantially horizontal. During use, the synchronization cables 90, 92, 102 and 104 tend to stretch leading to unsynchronization. To retension the synchronization cables, the turnbuckle 70 is turned to decrease the length of the return cable 62 thereby rotating the support beam 12 about the pivot pin 17 to lower the second end 16 of the support beam 12 and increase the downward load. The first end 14 rotates upwardly increasing the upward load on the synchronization cables. Since the brackets 20,and 34 rotate about the pin 22, the pair of cables attached to each bracket automatically balance the load. Thus, it is only necessary to adjust the single return cable 62 in order to retension the entire synchronization assembly 10.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for synchronizing the movement of telescoping parts of a hydraulic elevator jack comprising:

a mounting means adapted to be attached to an elevator guide rail;

a generally horizontally extending support beam having a first end and a second end opposite said first end, said beam being pivotably attached to said mounting means intermediate said first end and said second end;

at least one synchronization bracket pivotably attached to said first end of said beam and adapted to be attached to one end of each of a pair of synchronization cables each having an opposite end adapted to be attached to a telescoping part of an elevator jack; and a return cable attachment means at said second end of said support beam and adapted to be attached to one end of a return cable.

2. The apparatus according to claim 1 wherein said mounting means includes a pivot plate pivotally attached to said support beam.

3. The apparatus according to claim 1 including a bracket stop attached to said first end of said support arm for limiting pivoting movement of said one synchronization bracket.

4. The apparatus according to claim 1 including another synchronization bracket pivotally attached to said one end of said support beam and adapted to be attached to one end of each of another pair of synchronization cables each having an opposite end adapted to be attached to another telescoping part of the elevator jack.

5. The apparatus according to claim 1 wherein said return cable attachment means includes a return bracket pivotally attached to said second end of said support beam and adapted to be attached to one end of a return cable.

6. An apparatus for synchronizing the movement of telescoping parts of a hydraulic elevator jack comprising:

a pivot plate adapted to be attached to an elevator guide rail;

an elongated support beam having a first end and a second end opposite said first end, said beam being pivotably attached to said pivot plate intermediate said first end and said second end;

at least one synchronization bracket pivotably attached to said first end of said beam;

a pair of synchronization cables each having one end attached to said one synchronization bracket and an opposite end adapted to be attached to a telescoping part of an elevator jack; and a return cable having one end attached to said second end of said support beam and an opposite end adapted to be attached to a fixed point in an elevator hoistway.

7. The apparatus according to claim 6 including a bracket stop attached to said first end of said support arm for limiting pivoting movement of said one synchronization bracket.

8. The apparatus according to claim 6 including a return bracket pivotally attached to said second end of said support beam, said one end of said return cable being attached to said return bracket.

9. The apparatus according to claim 6 including a turnbuckle attached to said return cable for adjusting a distance between said second end of said support beam and the fixed point when said pivot plate is attached to a guide rail in the elevator hoistway.

10. The apparatus according to claim 9 including an anchor plate adapted to be mounted on an elevator pit floor, said turnbuckle being connected between said opposite end of said return cable and said anchor plate.

11. The apparatus according to claim 6 including another synchronization bracket pivotally attached to said one end of said support beam and another pair of said synchronization cables each having one end attached to said another synchronization bracket and an opposite end adapted to be attached to another telescoping part of the elevatorjack.

12. The apparatus according to claim 6 wherein said one synchronization bracket and said return bracket are configured substantially the same.

* * * * *